US005510047A

United States Patent [19]

Gabriel et al.

[11] Patent Number: 5,510,047

[45] Date of Patent: Apr. 23, 1996

[54] PROCESS FOR PREPARING THIXOTROPIC LIQUID DETERGENT COMPOSITIONS

[75] Inventors: Steven M. Gabriel; Thomas H. Glassco; Hal Ambuter; Edward P. Fitch, all of Cincinnati, Ohio

[73] Assignee: The Procter & Gamble Company, Cincinnati, Ohio

[21] Appl. No.: 270,841

[22] Filed: Jul. 5, 1994

Related U.S. Application Data

[63] Continuation of Ser. No. 867,941, Apr. 13, 1992, abandoned.

[51] Int. Cl.[6] ..... C11D 9/00; C11D 11/00

[52] U.S. Cl. ..... 252/89.1; 252/94; 252/95; 252/96; 252/108; 252/174.23; 252/DIG. 2; 252/DIG. 12; 252/DIG. 14

[58] Field of Search ..... 252/89.1, 94, 108, 252/174.23, DIG. 2, 95, DIG. 12, DIG. 14, 96

[56] References Cited

U.S. PATENT DOCUMENTS

| | | | |
|---|---|---|---|
| 2,634,907 | 4/1953 | Smith | 252/108 |
| 3,862,049 | 1/1975 | McGrath et al. | 252/108 |
| 4,076,643 | 2/1978 | Brahm et al. | 252/89 R |
| 4,101,457 | 7/1978 | Place et al. | 252/559 |
| 4,116,849 | 9/1978 | Leikhim | 252/103 |
| 4,162,987 | 7/1979 | Maguire et al. | 252/135 |
| 4,714,562 | 12/1987 | Roselle et al. | 252/94 |
| 4,732,703 | 3/1988 | van Voorst Vader et al. | 252/532 |
| 4,740,327 | 4/1988 | Julemont | 252/103 |
| 4,752,409 | 6/1988 | Drapier et al. | 252/94 |
| 4,772,434 | 9/1988 | Myers | 264/8 |
| 4,824,590 | 4/1989 | Roselle | 252/90 |
| 4,836,948 | 6/1989 | Corring | 252/99 |
| 4,839,077 | 6/1989 | Cramer et al. | 252/98 |
| 4,917,812 | 4/1990 | Cilley | 252/99 |
| 4,992,107 | 2/1991 | Itoku et al. | 134/77 |
| 5,041,239 | 8/1991 | Rorig et al. | 252/315.1 |
| 5,053,158 | 10/1991 | Dixit et al. | 252/99 |
| 5,057,237 | 10/1991 | Drapier et al. | 252/97 |
| 5,064,553 | 11/1991 | Dixit et al. | 252/94 |
| 5,075,027 | 12/1991 | Dixit et al. | 252/174.11 |
| 5,188,752 | 2/1993 | Prencipe et al. | 252/96 |
| 5,192,462 | 3/1993 | Gloor et al. | 252/174.21 |
| 5,213,706 | 5/1993 | Rapisarda et al. | 252/135 |
| 5,234,621 | 8/1993 | Weinstein et al. | 252/174.17 |
| 5,348,682 | 9/1994 | Finley et al. | 252/186.36 |

FOREIGN PATENT DOCUMENTS 0460810 12/1991 European Pat. Off. .

OTHER PUBLICATIONS

Copending U.S. patent application Ser. No. 07/708,826, Wise, filed May 29, 1991.

Copending U.S. patent application Ser. No. 07/867,575, Marshall et al, filed Apr. 13, 1992.

*Primary Examiner*—Gary P. Straub
*Assistant Examiner*—Timothy C. Vanoy
*Attorney, Agent, or Firm*—Thomas G. Krivulka; Mary P. McMahon

[57] ABSTRACT

A process for preparing viscoelastic, thixotropic, liquid, polymer-containing detergent compositions which exhibit increased density, enhanced aesthetics and improved rheological efficiency of the polymer is provided. The polymer thixotropic thickening agent is simultaneously added and mixed as a slurry to a premix under moderate to high shear rate to neutralize and disperse the polymer. The product is deaerated to increase density and enhance aesthetics by continued mixing under low to moderate shear rate of the slurry/premix composition. Sequential addition and mixing to the slurry/premix of organic solvent, oil, suds suppressors and solid material can aid in the deaeration step.

19 Claims, No Drawings

PROCESS FOR PREPARING THIXOTROPIC LIQUID DETERGENT COMPOSITIONS

This is a continuation of application Ser. No. 07/867,941, filed on Apr. 3, 1992 now abandoned.

TECHNICAL FIELD

The present invention relates to a process for making stable viscoelastic, thixotropic, liquid polymer-containing detergent compositions which exhibit increased density, enhanced aesthetics, and good theological efficiency of the polymer. The process comprises adding and mixing a polymeric thickener slurry simultaneously with a premix of other detergent ingredients until a desired viscosity has been achieved, this step is followed by deaeration of the mixture by mixing. The slurry is simultaneously added to the premix at high shear for a sufficient period of time to disperse and neutralize the polymer without redestructing the polymer.

BACKGROUND OF THE INVENTION

Because of their convenience, dispensing characteristics and aesthetics, liquid and/or gel detergent compositions are becoming an increasingly popular alternative to granular compositions among consumers. However, liquid and/or gel formulations often do not deliver the same effective performance as a granular composition.

To clean effectively, liquid/gel and granular detergent compositions contain chlorine bleach and have high alkalinity (i.e. silicate, carbonate and caustic). See, for example, U.S. Pat. No. 4,116,849, Leikhim, issued Sep. 26, 1978, U.S. Pat. No. 5,064,553, Dixit et al, issued Nov. 12, 1991 and U.S. Pat. No. 4,917,812, Cilley, issued Apr.17, 1990. Automatic dishwashing detergent compositions have been disclosed which use enzymes in place of chlorine bleach, for example, U.S. Pat. No. 4,162,987, Maguire et al, issued Jul. 31, 1979 and U.S. Pat. No. 4,101,457, Place et al, issued Jul. 18, 1978.

Liquid automatic dishwashing detergent compositions and processes have been disclosed to address the problems associated with rheology and other physical characteristics. See for example U.S. Pat. No. 5,075,027, Dixit et al, issued Dec. 24, 1991, U.S. Pat. No. 4,824,590, Roselle, issued Apr. 25, 1989, and U.S. Pat. No. 4,740,327, Julemont et al, issued Apr. 26, 1988.

It has been found that a viscoelastic, thixotropic, liquid, polymer-containing detergent composition can be formed with increased density, enhanced aesthetics and improved rheological efficiency of the polymer. Surprisingly, the simultaneous addition and mixing of a polymer slurry to a premix of detergent ingredients at moderate to high shear rate to neutralize and disperse the polymer, followed by deaeration of the resulting mixture yields a composition which has an increased density, enhanced aesthetics and a stable polymeric thixotropic thickener. Deaeration enhances aesthetics and increases the density of the composition. Simultaneously blending the polymer slurry with the premix at a high shear rate for a period sufficient to neutralize and disperse the polymer prevents undue rheodestruction of the polymeric thixotropic thickener.

SUMMARY OF THE INVENTION

This invention is a process for making a viscoelastic, thixotropic, liquid, polymer-containing automatic dishwashing detergent composition comprising:

(a) forming a slurry of from about 0.01% to about 40%, by weight of said slurry, of a polymeric, thixotropic thickener in a liquid medium;

(b) separately mixing to form a premix composition comprising detergency builder, pH adjusting agent, fatty acid, rheology stabilizing agent, organic disperant, detergent surfactant, suds suppressor, enzyme stabilizing system, rheology stabilizing agent, oxidizing agents, water, and mixtures thereof;

(c) simultaneously adding and mixing under moderate to high shear said slurry of step (a) with said premix of step (b) for a sufficient period of time to neutralize and disperse said polymer to form a composition with a viscosity of at least about 250 centipoise; and (d) deaerating by mixing under low to moderate shear rate said composition of step (c) to form a final product with a specific gravity of about 1.0 to about 2.0.

A particularly preferred embodiment of this invention includes sequentially adding and mixing from about 0.01% to about 40%, by weight, of organic solvents, oils, suds suppressors and solid material to aid in the deaeration step (d). In addition, a final step (e) of adding and mixing detergent ingredients which are high foaming, foam stabilizing, pH sensitive, temperature sensitive or high shear sensitive, to the composition of step (d) rather than in the premix of step (b) is preferred.

DETAILED DESCRIPTION OF THE INVENTION

The present invention encompasses processes for preparing viscoelastic, thixotropic, liquid, polymer-containing detergent compositions which exhibit increased density and improved polymeric thixotropic thickener stability. These detergent compositions contain the following components by weight of the composition:

(1) from about 0.1% to about 10% of a polymeric, thixotropic thickener;

(2) from about 0.01% to about 40% of a detergent surfactant and/or a detergent builder or mixtures thereof; and (3) sufficient pH adjusting agent to provide a viscoelastic, thixotropic, liquid, polymer-containing detergent composition with a product pH between about 7 and about 14. Various other optional ingredients, fatty acids, oxidizing agents, dyes, suds control agents, organic dispersants, enzymes, enzyme stabilizing systems, rheology stabilizing agents, and the like, can be added to provide additional performance and aesthetic benefits.

Compositions of the invention exhibit increased density, enhanced aesthetics and good rheological efficiency of the polymer are by preparing the viscoelastic, thixotropic, liquid, polymer-containing detergent composition by the following method:

(a) forming a slurry of from about 0.01% to about 40%, by weight of said slurry, of a polymeric, thixotropic thickener in a liquid medium;

(b) separately mixing to form a premix composition comprising detergency builder, pH adjusting agent, fatty acid, rheology stabilizing agent, organic disperant, detergent surfactant, suds suppressor, enzyme stabilizing system, rheology stabilizing agent, oxidizing agents, water, and mixtures thereof;

(c) mixing under moderate to high shear said slurry of step (a) with said premix of step (b) for a sufficient period of time to neutralize and disperse said polymer to and form a composition with a viscosity of at least about 250 centipoise; and (d) deaerating by mixing under low to moderate shear rate said composition of step (c) to form a final product with a specific gravity of about 1.0 to about 2.0. Step (d) can further comprise sequentially adding and mixing from about 0.01% to about 40%, by weight, of organic solvents, oils, suds suppressors, solid detergent material, and mixtures thereof.

The term thixotropic means the material exhibits a decrease in viscosity with increasing shear. In other words it exhibits high viscosity when subjected to low shear rate and lower viscosity when subjected to high shear rate. A viscoelastic liquid exhibits a steady state flow behavior after a constant stress has been applied for a sufficiently long period of time.

The term blending as used herein is a means of mixing the ingredients in such a manner that all the ingredients are sufficiently dispersed.

The term slurry as used herein means either the polymeric, thixotropic thickener is substantially dissolved or substantially dispersed in a liquid medium.

The term rheodestruction means permanent destruction of the thickening capability of the polymer thickening agent.

Thickening Agent

The viscoelastic, thixotropic thickening agent in the compositions of the present invention is from about 0.1% to about 10%, preferably from about 0.25% to about 5%, most preferably from about 0.5% to about 3%, by weight of the detergent composition. In compositions containing enzymes, the viscoelastic, thixotropic thickening agent should be free of any enzymatically reactive species. Without being bound by theory, it is believed that the enzyme(s) present in the automatic detergent composition could degrade the thickening agent which contains such species, resulting in a rheologically unstable product.

Preferably the thickening agent is a polymer with a molecular weight from about 500,000 to about 10,000,000, more preferably from about 750,000 to about 4,000,000.

The polymer is preferably a polycarboxylate polymer, more preferably a carboxyvinyl polymer. Such compounds are disclosed in U.S. Pat. No. 2,798,053, issued on Jul. 2, 1957, to Brown, the specification of which is hereby incorporated by reference. Methods for making carboxyvinyl polymers are also disclosed in Brown. Carboxyvinyl polymers are substantially insoluble in liquid, volatile organic hydrocarbons and are dimensionally stable on exposure to air.

Preferred polyhydric alcohols used to produce carboxyvinyl polymers include polyols selected from the class consisting of oligosaccarides, reduced derivatives thereof in which the carbonyl group is converted to an alcohol group, an pentaerythritol; most preferred is sucrose or pentaerythritol. It is preferred that the hydroxyl groups of the modified polyol be etherified with allyl groups, the polyol having at least two allyl ether groups per polyol molecule. When the polyol is sucrose, it is preferred that the sucrose have at least about five allyl ether groups per sucrose molecule. It is preferred that the polyether of the polyol comprise from about 0.1% to about 4% of the total monomers, more preferably from about 0.2% to about 2.5%.

Preferred monomeric olefinically unsaturated carboxylic acids for use in producing carboxyvinyl polymers used herein include monomeric, polymerizable, alpha-beta monoolefinically unsaturated lower aliphatic carboxylic acids; more preferred are monomeric monoolefinic acrylic acids of the structure

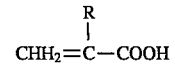

where R is a substituent selected from the group consisting of hydrogen and lower alkyl groups; most preferred is acrylic acid.

Various carboxyvinyl polymers, nomopolymers and copolymers are commercially available from B. F. Goodrich Company, New York, N.Y. , under the trade name Carbopol®. These polymers are also known as carbomers or polyacrylic acids. Carboxyvinyl polymers useful in formulations of the present invention include Carbopol 910 having a molecular weight of about 750,000, Carbopol 941 having a molecular weight of about 1,250,000, and Carbopols 934 and 940 having molecular weights of about 3,000,000 and 4,000,000, respectively. More preferred are the series of Carbopols which use ethyl acetate and cyclohexane in the manufacturing process, Carbopol 981, 2984, 980, and 1382.

Preferred polycarboxylate polymers of the present invention are non-linear, water-dispersible, polyacrylic acid cross-linked with a polyalkenyl polyether and having a molecular weight of from about 750,000 to about 4,000,000.

Highly preferred examples of these polycarboxylate polymers for use in the present invention are Sokal an PHC-25®, a polyacrylic acid available from BASF Corporation, the Carbopol 600 series resins available from B. F. Goodrich, and more preferred is Polygel DK available from 3-V Chemical Corporation. Mixtures of polycarboxylate polymers as herein described may also be used in the present invention.

The polycarboxylate polymer thickening agent is preferably utilized with essentially no clay thickening agents since the presence of clay usually results in a less desirable product having opacity and phase instability. In other words, the polycarboxylate polymer is preferably used instead of clay as a thickening agent in the present compositions.

Other types of thickeners which can be used in this composition include natural gums, such as xantham gum, locust bean gum, guar gum, and the like. The cellulosic type thickeners hydroxyethyl and hydroxymethyl cellulose (ETHOCEL and METHOCEL, available from Dow Chemical) can also be used.

The polymer thickening agent is generally available as a fine powder in acidic form (from about pH 2 to about pH 4), or in a neutralized state (about pH 7) in a preslurried state (liquid state), preferably a fine powder in acidic form is used. Polymer powder is very hygroscopic and therefore requires careful handling in order to achieve a fine dispersion of the polymer in a final product.

The polymer thickener in its acidic form is tightly coiled. Upon dispersion in a liquid medium, the molecules become hydrated and uncoil to some extent. To generate high and maximum viscosities, the polymer must be further extended and uncoiled. The most preferred method to achieve this is by neutralization. See BF Goodrich, Catalogue GC-67.

The polymeric, thixotropic thickening agent is preferably prepared as a slurry to maximize thickening efficiency, to avoid lumps of concentrated polymer in finished product and to avoid low pH sites in the finished product which under certain conditions could lead to rheology loss. The slurry is formed under moderate to high shear rate using conventional in-line blending to substantially dissolve and/or disperse the polymer without subjecting the polymer to long periods of shear. Conventional in-line blenders include ejector mixers, eductors, colloid mills, homogenizers and the like, preferably ejector mixers. The slurry comprises a liquid medium which can be any liquid detergent ingredient, preferably selected from the group consisting of water, water with a pH less than 7.0, detergent surfactant and mixtures thereof, and from about 0.01% to about 40%, preferably from about 0.1% to about 10%, most preferably from about 1% to about 6%, by weight of said slurry, of polymeric thickening agent. Preferably the liquid medium is acidic water, pH about 2.

Alternatively, the polymeric, thickening agent slurry can also be obtained by directly adding the polymer thickening agent to a well agitated vessel containing liquid medium (batch addition). Agitation is achieved by conventional methods such as paddle mixers, axial flow turbines, pitch turbines and the like, preferably pitch turbines.

In addition, other powder form ingredients may be dry blended with the polymer powder prior to dispersion to further aid in processing.

In the preferred viscoelastic, thixotropic, liquid, polymer-containing detergent composition, preferably a gel automatic dishwashing detergent composition, the polycarboxylate polymer thickening agent provides an apparent viscosity at high shear of greater than about 250 centipoise and an apparent yield value of from about 40 to about 800, and most preferably from about 60 to about 600, dynes/cm$^2$ to the composition.

Viscosity is a measure of the internal resistance to flow exhibited by a fluid in terms of the ratio of the shear stress to the shear rate. The yield value is an indication of the shear stress at which the gel strength is exceeded and flow is initiated. Yield value can be measured herein with a Brookfield RVT model viscometer with a T-bar B spindle at about 77° F. (25° C.) utilizing a Helipath drive during associated readings. The system is set to 0.5 rpm and a torque reading is taken for the composition to be tested after 30 seconds or after the system is stable. The system is stopped and the rpm is reset to 1.0 rpm. A torque reading is taken for the same composition after 30 seconds or after the system is stable. Apparent viscosities are calculated from the torque readings using factors provided with the Brookfield viscometer. An apparent Brookfield yield value is then calculated as: Brookfield Yield Value=(apparent viscosity at 0.5 rpm—apparent viscosity at 1 rpm)/100. This is the common method of calculation, published in Carbopol literature from the B. F. Goodrich Company and in other published references. In the cases of most of the formulations quoted herein, this apparent yield value is approximately four times higher than yield values calculated from shear rate and stress measurements in more rigorous rheological equipment.

Apparent viscosities at high shear are determined with a Brookfield RVT viscometer with spindle #6 at 100 rpm, reading the torque at 30 seconds.

A preferred method herein for measuring viscosity and yield value is with a Contraves Rheomat 115 viscometer which utilizes a Rheoscan 100 controller, a DIN 145 spindle and cup at 25° C. For viscosity measurements, the shear rate is increased from 0 to 150 sec-1 over a 30 second time period. The viscosity, measured in centipoise, is taken at a shear rate of 150 sec-1. The shear rate for yield value measurements is increased linearly from 0 to 0.4 sec-1 over a period of 500 seconds after an initial 5 minute rest period.

pH Adjusting Agent

In the instant compositions, one or more buffering agents can be included which are capable of maintaining the pH of the compositions within the desired alkaline range. The pH of the undiluted composition ("as is") is determined at room temperature (about 20° C.) with a pH meter. It is in the low alkaline pH range that optimum performance and stability of an enzyme are realized, and it is also within this pH range wherein optimum compositional chemical and physical stability are achieved. For compositions herein containing chlorine bleach, it is the high alkaline range that optimum performance and stability is achieved.

Maintenance of the composition pH between about 7 and about 14, preferably between about 8 and about 11.5, for compositions herein containing enzymes and preferably between about 10 and about 13 for compositions herein containing chlorine. The lower pH range for enzyme containing compositions of the invention minimizes undesirable degradation of the active enzymes.

The pH adjusting agents are generally present in a level from about 0.001% to about 25%, preferably from about 0.5% to about 20% by weight of the detergent composition. These agents are preferably ingredients of the premix of step (b) of the invention.

Any compatible material or mixture of materials which has the effect of maintaining the composition pH within the pH range of about 7 to about 14, preferably about 8 to about 13, can be utilized as the pH adjusting agent in the instant invention. Such agents can include, for example, various water-soluble, inorganics salts such as the carbonates, bicarbonates, sesquicarbonates, pyrophosphates, phosphates, silicates, tetraborates, and mixtures thereof. Silicates are not included in compositions of the invention which contain enzyme because of their high alkaline buffering properties; however, silicates are desirable in compositions containing chlorine bleach.

Examples of preferred materials which can be used either alone or in combination as the pH adjusting agent herein include sodium carbonate, sodium bicarbonate, potassium carbonate, sodium sequicarbonate, sodium pyrophosphate, tetrapotassium pyrophosphate, tripotassium phosphate, trisodium phosphate, organic amines and their salts such as monoethanol amine (MEA), anhydrous sodium tetraborate, sodium tetraborate pentahydrate, potassium hydroxide, sodium hydroxide, and sodium tetraborate decahydrate. Combinations of these pH adjusting agents, which include both the sodium and potassium salts, may be used.

Detergent Surfactants

The compositions of this invention can contain from about 0.01% to about 40%, preferably from about 0.1% to about 30% of a detergent surfactant. In the preferred automatic dishwashing detergent compositions of the invention the detergent surfactant is most preferably low foaming by itself or which in combination with other components (i.e. suds suppressors) is low foaming.

In a preferred embodiment the detergent surfactant is added as an ingredient to the premix step (b) of the invention, more preferably the detergent surfactant is added after the deaeration step(d) to avoid foaming while mixing the polymer slurry with the premix.

Compositions which are chlorine bleach free do not require the surfactant to be bleach stable. However, since these compositions often contain enzymes as an essential ingredient, the surfactant employed is preferably enzyme stable (enzyme compatible) and free of enzymatically reactive species. For example, when proteases and amylases are employed, the surfactant should be free of peptide or glycosidic bonds.

Desirable detergent surfactants include nonionic, anionic, amphoteric and zwitterionic detergent surfactants, and mixtures thereof.

Examples of nonionic surfactants include:

(I) The condensation product of 1 mole of a saturated or unsaturated, straight or branched chain, alcohol or fatty acid containing from about 10 to about 20 carbon atoms with from about 4 to about 40 moles of ethylene oxide. Particularly preferred is the condensation product of a fatty alcohol containing from 17 to 19 carbon atoms, with from about 6 to about 15 moles, preferably 7 to 12 moles, most preferably 9 moles, of ethylene oxide provides superior spotting and filming performance. More particularly, it is desirable that the fatty alcohol contain 18 carbon atoms and be condensed with from about 7.5 to about 12, preferably about 9 moles of ethylene oxide. These various specific $C_{17}$-$C_{19}$ ethoxylates give extremely good performance even at lower levels (e.g., 2.5%–3%). At the higher levels (less than 5%), they are sufficiently low sudsing, especially when capped with a low molecular weight ($C_{1-5}$) acid or alcohol moiety, so as to minimize or eliminate the need for a suds-suppressing agent. Suds-suppressing agents in general tend to act as a load on the composition and to hurt long term spotting and filming characteristics.

(2) Polyethylene glycols or polypropylene glycols having molecular weight of from about 1,400 to about 30,000, e.g., 20,000; 9,500; 7,500; 7,500; 6,000; 4,500; 3,400; and 1,450. All of these materials are wax-like solids which melt between 110° F. (43° C.) and 200° F. (93° C.).

(3) The condensation products of 1 mole of alkyl phenol wherein the alkyl chain contains from about 8 to about 18 carbon atoms and from about 4 to about 50 moles of ethylene oxide.

(4) Polyoxypropylene, polyoxyethylene condensates having the formula $HO(C_2H_6O)_x(C_3H_6O)_xH$ or $HO(C_3H_6O)_y(C_2H_4O)_x(C_3H_6O)_yH$ where total y equals at least 15 and total $(C_2H_4O)$ equals 20% to 90% of the total weight of the compound and the molecular weight is from about 2,000 to about 10,000, preferably from about 3,000 to about 6,000. These materials are, for example, the PLURONICS®which are well known in the art.

(5) the compounds of (1) and (4) which are capped with propylene oxide, butylene oxide and/or short chain alcohols and/or short chain fatty acids, e.g., those containing from 1 to about 5 carbon atoms, and mixtures thereof.

Useful surfactants in detergent compositions are those having the formula $RO—(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $—(C_yH_{2y}O)_nH$ wherein y is 3 or 4 and n is a number from one to about 4.

Particularly suitable surfactants are the low-sudsing compounds of (4), the other compounds of (5), and the $C_{17}$-$C_{19}$ materials of (1) which have a narrow ethoxy distribution. Certain of the block co-polymer surfactant compounds designated PLURONIC, PLURAFAC® and TETRONIC® by the BASF Corp., Parsippany, N.J. are suitable as the surfactant for use herein. A particularly preferred embodiment contains from about 40% to about 70% of a polyoxypropylene, polyoxethylene block polymer blend comprising about 75%, by weight of the blend, of a reverse block co-polymer of polyoxyethylene and polyoxypropylene containing 17 moles of ethylene oxide and 44 mole of propylene oxide; and about 25%, by weight of the blend, of a block copolymer of polyoxyethylene and polyoxypropylene, initiated with tri-methylol propane, containing 99 moles of propylene oxide and 24 moles of ethylene oxide per mole of trimethylol propane.

Additional nonionic type surfactants which may be employed have melting points at or above ambient temperatures, such as octyldimethylamine N-oxide dihydrate, decyldimethylamine N-oxide dihydrate, C8–C12 N-methyl -glucamides and the like. Such surfactants may advantageously be blended in the instant compositions with short-chain anionic surfactants, such as sodium octyl sulfate and similar alkyl sulfates, though short-chain sulfonates such as sodium cumene sulfonate could also be used.

In addition to the above mentioned surfactants, other suitable surfactants for detergent compositions can be found in the disclosures of U.S. Pat. Nos. 3,544,473, 3,630,923, 3,888,781 and 4,001,132, all of which are incorporated herein by reference.

Anionic surfactants which are suitable for the compositions of the present invention include, but are not limited to, water soluble-alkyl sulfates and/or sulfonates, containing from about 8 to about 18 carbon atoms. Natural fatty alcohols include those produced by reducing the glycerides of naturally occurring fats and oils. Fatty alcohols can be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, magnesium coconut alkyl sulfate, calcium coconut alkyl sulfate, potassium coconut alkyl sulfate and mixtures thereof. Highly preferred alkyl sulfates are sodium coconut alkyl sulfate, potassium coconut alkyl sulfate, potassium lauryl alkyl sulfate and sodium lauryl alkyl sulfate.

A preferred sulfonated anionic surfactant is the alkali metal salt of secondary alkane sulfonates, an example of which is the Hostapur SAS from Hoechst Celanese.

Another cl ass of surfactants operable in the present invention are the water-soluble betaine surfactants. These materials have the general formula:

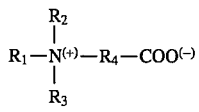

wherein $R_1$ is an alkyl group containing from about 8 to 22 carbon atoms; $R_2$ and $R_3$ are each lower alkyl groups containing from about 1 to 5 carbon atoms, and R4 is an alkylene group selected from the group consisting of methylene, propylene, butylene and pentylene. (Propionate betaines decompose in aqueous solution and hence are not included in the instant compositions).

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanoate and tetradecyldipropylammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

Other surfactants include amine oxides, phosphine oxides, and sulfoxides. However, such surfactants are usually high sudsing. A disclosure of surfactants can be found in published British Patent Application 2,116,199A; U.S. Pat. No. 4,005,027, Hartman; U.S. Pat. No. 4,116,851, Rupe et al; U.S. Pat. No. 3,985,668, Hartman; U.S. Pat. No. 4,271,030, Brierley et al; and U.S. Pat. No. 4,116,849, Leikhim, all of which are incorporated herein by reference.

Other desirable surfactants are the alkyl phosphonates, taught in U.S. Pat. No. 4,105,573 to Jacobsen issued Aug. 8, 1978, incorporated herein by reference.

Still other preferred anionic surfactants include the linear or branched alkali metal mono- and/or di-($C_{8-14}$) alkyl diphenyl oxide mono- and/or disulfonates, commercially available under the trade names DOWFAX® 3B-2 (sodium n-decyl diphenyloxide disulfonate) and DOWFAX® 2A-1. These and similar surfactants are disclosed in published U.K. Patent Applications 2,163,447A; 2,163,448A; and 2,164,350A, said applications being incorporated herein by reference.

Detergency Builder

Detergency builders can be added to the present invention in levels from about 0.01% to about 40%, preferably from about 0.1% to about 30%, most preferably from about 2% to about 25% by weight of the composition. The builders reduce the free calcium and/or magnesium ion concentration providing additional cleaning benefits. In addition, builders are generally supplied in a solid form and are therefore useful in the deaeration step (d) of the invention.

The builders are preferably added as an ingredient of the premix of step (b) of the present invention. More preferably because of the solid form of the builder, a portion of the builder is added in the premix of step (b) and the remaining amount of builder is added under low to moderate shear for the deaeration of step (d). In compositions where enzymes are present, the builder is preferably added to the premix after any enzyme stabilizing system described herein is added.

The detergency builder can be any of the detergent builders known in the art which include trisodium phosphate, tetrasodium pyrophosphate, sodium tripolyphosphate, sodium hexametaphosphate, potassium pyrophosphate, potassium tripolyphosphate, potassium hexametaphosphate, sodium carbonate, sodium bicarbonate, sodium hydroxide, potassium silicate, sodium silicate, borax, sodium nitrilotriacetate, potassium nitrilotriacetate, sodium carboxymethyloxysuccinate, sodium carboxymethyloxymalonate, oxydisuccinate, polyphosphonates, salts of low molecular weight carboxylic acids, such as citrate builders, particularly sodium citrate, and polycarboxylates, such as polyacrylates or polymaleates, copolymers and mixtures thereof.

Other suitable builders include ether carboxylates such as tartrate monodisuccinate and tartrate disuccinate, which can be found in the disclosures of U.S. Pat. Nos. 3,566,984 and 4,663,071, both incorporated herein by reference.

The preferred builder in an enzyme containing composition herein is citric acid or an alkali metal citrate such as sodium citrate in levels from about 2% to about 25%, preferably from about 3% to about 20% by weight of the composition.

Some of the above-described detergency builders additionally serve as buffering agents. It is preferred that the buffering agent contain at least one compound capable of additionally acting as a builder.

Organic Solvent and Oil

Organic solvents and oils can be added to the composition of the invention to deaerate and yield a final product with a specific gravity of from about 1.0 to about 2.0. Suitable organic solvents and oils are those that are generally found in perfume sources. These solvents and oils include a class of compounds comprising alcohols, ketones, aldehydes, esters, and aromatics. Specific compounds can include those such as turpentine, benzene, toluene, xylenes, carbon tetrachloride, vegetable oils, mineral oils, and higher chain length alcohols such as octanol.

As used herein the term "perfume" is used to indicate any water-insoluble, pleasant smelling, odoriferous material characterized by a vapor pressure below atmospheric pressure at ambient temperatures. The perfume material will most often be liquid at ambient temperatures. A wide variety of chemicals are known for perfume uses, including materials such as aidehyde, ketones and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood oil, civet and patchouli oil. The perfumes can be of a light floral fragrance, e.g. rose extract, violet extract, and lilac. The perfumes can also be formulated to provide desirable fruity odors, e.g. lime, lemon and orange. Any chemically compatible material which exudes a pleasant or otherwise desirable odor can be used in the perfumed particles herein.

Without being bound by theory, it is believed that it is the organic solvents and/or oils of the perfume which can effectively deaerate the composition without extended agitation of the composition. This is achieved by a modification of the surface tension of the air bubbles.

In the particular case of compositions containing fatty acids, such as alkali metal stearates, it is believed that the organic solvents and oils also function to solvate the fatty acid out of the air phase. Particularly useful in these cases are those organic solvents and oils which effectively solubilize fatty acids. These materials should be selected on the basis of the fatty acid used in the composition as different solvents may have differing solubility effects. See for example Bulletin 170 published by Witco for specific examples of solvents that can be used for the common alkali metal stearates.

Preferably organic solvents, oils and/or active perfume levels are from about 0 to about 20%, more preferably from about 0.01% to about 10%, most preferably from about 0.01% to about 1%,by weight of the composition. The perfume may be added to the premix, preferably it is added to the composition in step (d) to aid in deaerating the composition.

Detersive Enzyme

The compositions of this invention can contain from about 0.001% to about 5%, more preferably from about 0.003% to about 4%, most preferably from about 0.005% to about 3%, by weight, of active detersive enzyme.

The preferred detersive enzyme is selected from the group consisting of protease, amylase, lipase and mixtures thereof. Most preferred are protease or amylase or mixtures thereof.

The proteolytic enzyme can be of animal, vegetable or microorganism (preferred) origin. More preferred is serine proteolytic enzyme of bacterial origin. Purified or nonpurified forms of this enzyme may be used. Proteolytic enzymes produced by chemically or genetically modified mutants are included by definition, as are close structural enzyme variants. Particularly preferred is bacterial serine proteolytic enzyme obtained from Bacillus, *Bacillus subtilis* and/or *Bacillus licheniformis.*

Suitable proteolytic enzymes include Alcalase®, Esperase®, Savinase® (preferred); Maxatase®, Maxacal® (preferred), and Maxapem® 15 (protein engineered Maxacal); and subtilisin BPN and BPN' (preferred); which are commercially available. Preferred proteolytic enzymes are also modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Preferred proteolytic enzymes, then, are selected from the group consisting of Savinase®, Esperase®, Maxacal®, BPN, Protease A and Protease B, and mixtures thereof. Esperase® is most preferred.

Suitable lipases for use herein include those of bacterial, animal, and fungal origin, including those from chemically or genetically modified mutants.

Suitable bacterial lipases include those produced by Pseduomonas, such as *Pseudomonas stutzeri* ATCC 19.154, as disclosed in British Patent 1,372,034, incorporated herein by reference. Suitable lipases include those which show a positive immunological cross-reaction with the antibody of the lipase produced the the microorganism *Pseudomonas fluorescens* IAM 1057. This lipase and a method for its purification have been described in Japanese Patent Application 53-20487, laid open on Feb. 24, 1978, which is incorporated herein by reference. This lipase is available under the trade name Lipas P "Amano," hereinafter s referred to as "Amano-P." Such lipases should show a positive immunological cross reaction with the Amano-P antibody, using the standard and well-known immunodiffusion procedure according to Oucheterlon (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Pseudomonas nitroreducens* var. lipolyticum FERM P 1338 (available under the trade name Amano-CES), lipases ex *Chromobacter viscosum* var. lipolyticum NRRlb 3673, and further *Chromobacter viscousm* lipases, and lipases ex *Pseudomonas gladioli.* Other lipases of interest are Amano AKG and Bacillis Sp lipase (e.g. Solvay enzymes).

Other lipases which are of interest where they are compatible with the composition are those described in EP A 0 339 681, published Nov. 28, 1990, EP A 0 385 401, published Sep. 5, 1990, EO A 0 218 272, published Apr. 15, 1987, and PCT/DK 88/00177, published May 18, 1989, all incorporated herein by reference.

Suitable fungal lipases include those produced by *Humicola lanuginosa* and *Thermomvces lanuqinosus.* Most preferred is lipase obtained by cloning the gene from *Humicola lanuginosa* and expressing the gene in *Aspergillus oryzae* as described in European Patent Application 0 258 068, incorporated herein by reference, commercially available under the trade name Lipolase® from Novo-Nordisk.

Any amylase suitable for use in a liquid detergent composition can be used in these compositions. Amylases include for example, α-amylases obtained from a special strain of *B. licheniforms,* described in more detail in British Patent Specification No. 1,296,839. Amylolytic enzymes include, for example, Rapidase™, Maxamyl™, Termamyl™ and BAN™.

In a preferred embodiment, from about 0.001% to about 5%, preferably 0.005% to about 3%, by weight of active amylase can be used. Preferably from about 0.005% to about 3% by weight of active protease can be used. Preferrably the amylase is Maxamyl™ and/or Termamyl™ and the protease is Esperase® and/or Savinase®.

Enzyme Stabilizing System

The preferred enzyme containing compositions herein comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the enzyme of the present invention. Such stabilizing systems can comprise calcium ion, boric acid, propylene glycol, short chain carboxylic acid, boronic acid, polyhydroxyl compounds and mixtures thereof.

The level of calcium ion should be selected so that there is always some minimum level available for the enzyme, after allowing for complexation with builders, etc., in the composition. Any water-soluble calcium salt can be used as the source of calcium ion, including calcium chloride, calcium formate, and calcium acetate. A small amount of calcium ion, generally from about 0.05 to about 0.4 millimoles per liter, is often also present in the composition due to calcium in the enzyme and formula water. Calcium ions can be used with boric acid or a suitable salt of boric acid, described herein below, in a composition with a product pH between about 7 and about 9. However, calcium ions and the salt of boric acid can associate to from calcium borate which is insoluble in cold water and under certain product conditions can be insoluble above about pH 9. This precipitate can lead to phase instability, decrease in effective enzyme stabilization and undesired product aesthetics. Therefore, a sufficient amount of calcium ion and boric acid or the salt of boric acid should be used to achieve enzyme stability without affecting phase stability, enzyme stability, or aesthetics. From about 0.03% to about 0.6%, more preferably from about 0.05% to about 0.45% of calcium formate is preferred.

Other suitable enzyme stabilizing systems comprise polyols containing only carbon, hydrogen and oxygen atoms. They preferably contain from about 2 to about 6 carbon atoms and from about 2 to about 6 hydroxy groups. Examples include propylene glycol (especially 1,2-propanediol, which is preferred), 1,2-butanediol, ethylene glycol, glycerol, sorbitol, mannitol, and glucose. The polyol generally represents from about 0.5% to about 10%, preferably from about 1.5% to about 8%, by weight of the composition. Preferably, the weight ratio of polyol to a boric acid added is at least 1, most preferably at least about 1.3.

The compositions can also contain the water-soluble short chain carboxylates described in U.S. Pat. No. 4,318,818, Letton et al., issued Mar. 9, 1982, incorporated herein by reference. The formates are preferred and can be used at levels from about 0.05% to about 5%, preferably from about 0.075% to about 2.5%, most preferably from about 0.1% to about 1.5%, by weight. Sodium formate is preferred.

Another stabilizing system comprises from about 0.05% to about 7%, preferably from about 0.1% to about 5%, by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate, and sodium pentaborate) are suitable.

Still another enzyme stabilizing system includes polyhydroxyl compounds, such as sugar alcohols, monosaccharides and discaccharides as disclosed in the specification of German Pat. No. 2,038,103, water-soluble sodium or potassium salts and water-soluble hydroxy alcohols, as disclosed in U.S. Pat. No. B-458,819, Weber, published Apr. 13, 1976; diamines and polyamines, as disclosed in German Pat. No. 2,058,826; amino acids, as disclosed in German Pat. No. 2,060,485; and reducing agents, as disclosed in Japanese Pat. No. 72-20235. Further, in order to enhance its storage stability, the enzyme mixture may be incorporated into the detergent composition in a coated, encapsulated, agglomerated, prilled, or noodled form in accordance with, e.g., U.S. Pat. No. 4,162,987, Maguire et al, issued Jul. 31, 1979.

Substituted boric acids (e.g. phenylboronic acid, butane boronic acid, and p-bromo phenylboronic acid) can also be used in place of boric acid. A particularly preferred boronic acid is an aryl boronic acid of the structure:

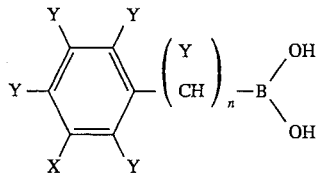

where x is selected from $C_1$-$C_6$ alkyl, substituted $C_1$-$C_6$ alkyl, aryl, substituted aryl, hydroxyl, hydroxyl derivative, amine $C_1$-$C_6$ alkylated amine, amine derivative, halogen, nitro, thiol, thio derivative, aidehyde, acid, acid salt, ester, sulfonate or phosphonate; each Y is independently selected from hydrogen, $C_1$-$C_6$ alkyl, substituted $C_1$-$C_6$ alkyl, aryl, substituted aryl, hydroxyl, hydroxyl derivative, halogen, amine, alkylated amine, amine derivative, nitro, thiol, thiol, thiol, derivative, aidehyde, acid, ester, sulfonate or phosphonate; and n is 0 to 4.

In addition to the above listed enzyme stabilizers, from 0 to about 10%, preferably from about 0.01% to about 6% by weight, of chlorine bleach scavengers can be added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of of water that comes in contact with the enzyme during dishwashing is usually large; accordingly, enzyme stability in-use can be problematic.

Suitable chlorine scavenger anions are salts containing ammonium cations. These can be selected from the group consisting of reducing materials like sulfite, bisulfite, thiosulfite, thiosulfate, iodide, etc., antioxidants like carbamate, ascorbate, etc., organic amines such as ethylenediaminetetracetic acid (EDTA) or alkali metal salt thereof and monoethanolamine (MEA), and mixtures thereof. Other conventional scavenging anions like sulfate, bisulfate, carbonate, bicarbonate, percarbonate, nitrate, chloride, borate, sodium perborate tetrahydrate, sodium perborate monohydrate, phosphate, condensed phosphate, acetate, benzoate, citrate, formate, lactate, malate, tartrate, salicylate, etc. and mixtures thereof can also be used.

Although the preferred ammonium salts can be simply admixed with the detergent composition, they are prone to adsorb water and/or give off ammonia gas. Accordingly, it is better if they are protected in a particle like that described in U.S. Pat. No. 4,652,392, Baginski et al, which is incorporated herein by reference. The preferred ammonium salts or other salts of the specific chlorine scavenger anions can either replace the suds controlling agent or be added in addition to the suds controlling agent.

Chlorine Bleach Ingredient

The instant compositions can include a bleach ingredient which yields a hypochlorite species in aqueous solution. The hypochlorite ion is chemically represented by the formula $OCl^-$. The hypochlorite ion is a strong oxidizing agent, and materials which yield this species are considered to be powerful bleaching agents.

The strength of an aqueous solution containing hypochlorite ion is measured in terms of available chlorine. This is the oxidizing power of the solution measured by the ability of the solution to liberate iodine from an acidified iodide solution. One hypochlorite ion has the oxidizing power of 2 atoms of chlorine, i.e., one molecule of chlorine gas.

At lower pH levels, aqueous solutions formed by dissolving hypochlorite-yielding compounds contain active chlorine, partially in the form of hypochlorous acid moleties and partially in the form of hypochlorite ions. At pH levels above about 10, i.e., at the pH levels of the instant compositions, essentially all (greater than 99%) of the active chlorine is reported to be in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, trichlorocyanuric acid, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium hypochlorite, potassium hypochlorite, or a mixture thereof.

Most of the above-described hypochlorite-yielding bleaching agents are available in solid or concentrated form and are dissolved in water during preparation of the compositions of the instant invention. Some of the above materials are available as aqueous solutions.

The above-described bleaching agents are dissolved in the aqueous liquid component of the present composition. Bleaching agents can provide from about 0 to about 5% available chlorine by weight, preferably from about 0.1% to about 2% available chlorine, by weight of the total composition. The bleaching agent can be added to the premix of step (b), more preferably the bleaching agent, because of its temperature and pH sensitivity, is added to the composition after the deaeration of step (d) of the invention.

Rheology Stabilizing Agent

The rheology stabilizing agents useful in the chlorine containing composition of the present invention have the formula:

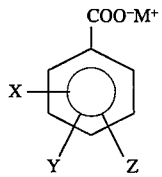

wherein each X, Y, and Z is —H, —$COO^-M^+$, —Cl, —Br, —$SO_3^-M^+$, —$NO_2$, —$OCH_3$, or a $C_1$ to $C_4$ alkyl and M is H or an alkali metal. Examples of this component include pyromellitic acid, i.e., where X, Y, and Z are —$COO^-H^+$; hemimellitic acid and trimellitic acid, i.e., where X and Y are —$COO^-H^+$and Z is —H.

Preferred rheology stabilizing agents of the present invention are sulfophthalic acid, i.e., where X is —$SO_3^{31}$ $H^+$, Y is —$COO^-H^+$, and Z is —H; other mono-substituted phthalic acids and di-substituted benzoic acids; and alkyl-, chloro-, bromo-, sulfo-, nitro-, and carboxy- benzoic acids, i.e., where Y and Z are —H and X is a $C_2$ to $C_4$ alkyl, —Cl, —Br, —$SO_3^-H^+$, —$NO_2$, and —$OCH_3$, respectively.

Highly preferred examples of the rheology stabilizing agents useful in the present invention are benzoic acid, i.e., where X, Y, and Z are —H; phthalic acid, i.e., where X is —$COO^-H^+$, and Y and Z are —H; and toluic acid, where X is —$CH_3$ and Y and Z are —H; and mixtures thereof.

All the rheology stabilizing agents described above are the acidic form of the species, i.e., M is H. It is intended that the present invention also cover the salt derivatives of these species, i.e., M is an alkali metal, preferably sodium or potassium. In fact, since the pH of compositions of the present invention are in the alkaline range, the rheology stabilizing agents exist primarily as the ionized salt in the aqueous composition herein. It is also intended the anhydrous derivatives of certain species described above be included in this invention, e.g., pyromellitic dianhydride, phthalic anhydride, sulfophthalic anhydride, etc.

Mixtures of the rheology stabilizing agents as described herein may also be used in the present invention.

This rheology stabilizing component is present in chlorine containing compositions in an amount of from about 0.05% to about 2%, preferably from about 0.1% to about 1.5%, most preferably from about 0.2% to about 1%, by weight, of the composition. The rheology stabilizing agent can be added as an ingredient of the premix of step (b), more preferably it is added in step (e) after the deaeration step (d).

Cross-linked polymers, especially those of high molecular weight, as used in the present bleach-containing composition, are vulnerable to bleach-initiated degradation and result in a loss of rheology that can be unacceptable for some applications. A certain small percentage of the chlorine bleach ingredient is present in solution in the form of a free radical, i.e., a molecular fragment having one or more unpaired electrons. These radicals, although short lived, are highly reactive and may initiate the degradation of certain other species in solution, including the cross-linked polycarboxylate polymers, via propagation mechanism. The polymers of this invention are susceptible to this degradation because of the presumed oxidizable sites present in the cross-linking structure.

A small addition of the rheology stabilizing agent substantially increases the physical stability, i.e., rheological stability, of the composition of the present invention when added. Without wishing to be bound by theory, it is believed that the rheology stabilizing agent functions as a free radical scavenger, tying up the highly reactive species in the composition and preventing them from attacking the degradation-susceptible structure of the polycarboxylate polymers.

Surprisingly though, other free radical scavengers are ineffective as the rheology stabilizing agent in the present invention because they react with chlorine bleach or are unable to impede the interaction between the bleach ingredient and the polymeric thickening agent. One of the preferred rheology stabilizing agents herein is benzoic acid. Benzoates have been characterized in the art as weak radical scavengers and nearly ineffective in an alkaline medium. However, phthalic and toluic acids, which have not been characterized as radical scavengers, function effectively as a rheology stabilizing agent.

Organic Dispersant

The present compositions can contain organic dispersant which overcomes the problem of unsightly films which form on china and especially on glassware due to calcium- or magnesium-hardness-induced precipitation of pH-adjusting agents, especially carbonates, used herein.

The organic dispersants herein can be used at levels of 0 to about 20%, typically from about 0.5% to about 17%, most preferably from about 1% to about 15% of the automatic dishwashing composition. Such organic dispersants are preferably water-soluble sodium polycarboxylates. ("Polycarboxylate" dispersants herein generally contain truly polymeric numbers of carboxylate groups, e.g., 8 or more, as distinct from carboxylate builders, sometimes called "polycarboxylates" in the art when, in fact, they have relatively low numbers of carboxylate groups such as four per molecule.) The organic dispersants are known for their ability to disperse or suspend calcium and magnesium "hardness", e.g., carbonate salts. Crystal growth inhibition, e.g., of Ca/Mg carbonates, is another useful function of such materials. Preferably, such organic dispersants are polyacrylates or acrylate-containing copolymers. "Polymeric Dispersing Agents, SOKALAN", a printed publication of BASF Aktiengesellschaft, D-6700 Ludwigshaven, Germany, describes organic dispersants useful herein. Sodium polyacrylate having a nominal molecular weight of about 4500, obtainable from Rohm & Haas under the trade name as ACUSOL® 445N, or acrylate/maleate copolymers such as are available under the trade name SOKALAN®, from BASF Corp., are preferred dispersants herein. These polyanionic materials are, as noted, usually available as viscous aqueous solutions, often having dispersant concentrations of about 30–50%. The organic dispersant is most commonly fully neutralized; e.g., as the sodium salt form.

While the foregoing encompasses preferred organic dispersants for use herein, it will be appreciated that other oligomers and polymers of the general polycarboxylate type can be used, according to the desires of the formulator. Suitable polymers are generally at least partially neutralized in the form of their alkali metal, ammonium or other conventional cation salts. The alkali metal, especially sodium salts, are most preferred. While the molecular weight of such dispersants can vary over a wide range, it preferably is from about 1,000 to about 500,000, more preferably is from about 2,000 to about 250,000, and most preferably is from about 3,000 to about 100,000. Nonlimiting examples of such materials are as follows.

For example, other suitable organic dispersants include those disclosed in U.S. Pat. No. 3,308,067 issued Mar. 7, 1967, to Diehl, incorporated herein by reference. Unsaturated monomeric acids that can be polymerized to form suitable polymeric polycarboxylates include maleic acid (or maleic anhydride), fumaric acid, itaconic acid, aconitic acid, mesaconic acid, citraconic acid and methylenemalonic acid. The presence of monomeric segments containing no carboxylate radicals such as vinylmethyl ether, styrene, ethylene, etc. is suitable, preferably when such segments do not constitute more than about 40% by weight of the polymer.

Other suitable organic dispersants for use herein are copolymers of acrylamide and acrylate having a molecular weight of from about 3,000 to about 100,000, preferably from about 4,000 to about 20,000, and an acrylamide content of less than about 50%, preferably less than about 20%, by weight of the polymer. Most preferably, the polymer has a molecular weight of from about 4,000 to about 10,000 and an acrylamide content of from about 1% to about 15%, by weight of the polymer.

Still other useful organic dispersants include acrylate/maleate or acrylate/fumarate copolymers with an average molecular weight in acid form of from about 2,000 to about 80,000 and a ratio of acrylate to maleate or fumarate segments of from about 30:1 to about 2:1. Other such suitable copolymers based on a mixture of unsaturated mono- and dicarboxylate monomers are disclosed in European Patent Application No. 66,915, published Dec. 15, 1982, incorporated herein by reference. Yet other organic dispersants are useful herein, as illustrated by water-soluble oxidized carbohydrates, e.g., oxidized starches prepared by art-disclosed methods.

Other Optional Materials

The compositions of the present invention may optionally comprise certain esters of phosphoric acid (phosphate ester). Phosphate esters are any materials of the general formula:

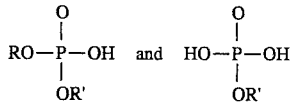

wherein R and R' are $C_6$-$C_{20}$ alkyl or ethoxylated alkyl groups. Preferably R and R' are of the general formula: alkyl-$(OCH_2CH_2)Y$ wherein the alkyl substituent is $C_{12}$-$C_{18}$ and Y is between 0 and about 4. Most preferably the alkyl substituent of that formula is $C_{12}$-$C_{18}$ and Y is between about 2 and about 4. Such compounds are prepared by known methods from phosphorus pentoxide, phosphoric acid, or phosphorus oxy halide and alcohols or ethoxylated alcohols.

It will be appreciated that the formula depicted represent mono- and di-esters, and commercial phosphate esters will generally comprise mixtures of the mono- and di-esters, together with some proportion of tri-ester. Typical commercial esters are available under the trademarks "Phospholan" PDB3 (Diamond Shamrock), "Servoxyl" VPAZ (Servo), PCUK-PAE (BASF-Wyandotte), SAPC (Hooker). Preferred for use in the present invention are KN340N and KL340N (Hoescht) and monostearyl acid phosphate (Occidental Chemical Corp.). Most preferred for use in the present invention is Hostophat-TP-2253 (Hoescht).

The phosphate esters useful herein provide protection of silver and silver-plated utensil surfaces. The phosphate ester component also acts as a suds suppressor in the anionic surfactant-containing detergent compositions disclosed herein.

If a phosphate ester component is used in the compositions of the present invention, it is generally present from about 0.1% to about 5%, preferably from about 0.15% to about 1.0% by weight of the composition.

Metal salts of long chain fatty acids and/or long chain hydroxy fatty acids have been found to be useful in automatic dishwashing detergent compositions as rheological modifiers and to inhibit tarnishing caused by repeated exposure of sterling or silver-plate flatware to bleach-containing automatic dishwashing detergent compositions (U.S. Pat. No. 4,859,358, Gabriel et al). By "long chain" is meant the higher aliphatic fatty acids or hydroxy fatty acids having from about 6 to about 24 carbon atoms, preferably from about 8 to 22 carbon atoms, and more preferably from about 10 to 20 carbon atoms and most preferably from about 12 to 18, inclusive of the carbon atom of carboxyl group of the fatty acid, e.g., stearic acid, and hydroxy stearic acid. By "metal salts" of the long chain fatty acids and/or hydroxy fatty acids is meant both monovalent and polyvalent metal salts, particularly the sodium, potassium, lithium, aluminum, and zinc salts, e.g., lithium salts of the fatty acids. Specific examples of this material are aluminum, potassium, sodium, calcium and lithium stearate or hydroxy stearate, particularly preferred is aluminum tristearate. If the metal salts of long chain hydroxy fatty acids are incorporated into the automatic dishwashing detergent compositions of the present invention, this component generally comprises from about 0.01% to about 2%, preferably from about 0.05% to about 0.2% by weight of the composition.

If fatty acids are to be used in the formulation, additional processing requirements may be needed. The most common fatty acid used in conventional liquid automatic dishwashing detergents are metal salts of stearate and hydroxy-stearate, for example aluminum tristearate and sodium stearate. Similar to the polymer thickener, these materials are difficult to process and should be substantially dispersed in the product in order to function as intended. There are various methods for incorporating the fatty acid material. The first is to add the material as a powder to the batch without any special processing steps—such as any solid form builder would be added. The batch should be well mixed and observed to ensure that a dispersion has been achieved. A more preferred method is to liquify the fatty acid or dissolve it in a hot liquid mixture and then add it to the batch. The most preferred method is to use an eductor or tri-blender to add the fatty acid to the premix. This most preferred method gives the best dispersion and is the least process intensive.

An alkali metal salt of an amphoteric metal anion (metalate), such as aluminate, can be added to provide additional structuring to the polycarboxylate polymer thickening agent. See U.S. Pat. No. 4,941,988, Wise, issued Jul. 17, 1990, incorporated herein by reference.

Compounds known, or which become known, for reducing or suppressing the formation of suds can be incorporated into the compositions of the present invention. Suitable suds suppressors are described in Kirk Othmer Encyclopedia of Chemical Technology, Third Edition, Volume 7, pages 430–447 (John Wiley & Sons, Inc., 1979), U.S. Pat. No. 2,954,347, issued Sep. 27, 1960 to St. John, U.S. Pat. No. 4,265,779, issued May 5, 1981 to Gandolfo et al., U.S. Pat. No. 4,265,779, issued May 5, 1981 to Gandolfo et al. and European Patent Application No. 89307851.9, published Feb. 7, 1990, U.S. Pat. No. 3,455,839, German Patent Application DOS 2,124,526, U.S. Pat. No. 3,933,672, Bartolotta et al., and U.S. Pat. No. 4,652,392, Baginski et al., issued Mar. 24, 1987. All are incorporated herein by reference.

The compositions hereof will generally comprise from 0% to about 5% of suds suppressor.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., propylene glycol, ethylene glycol, glycerine, and 1,2-propanediol) can also be used.

A wide variety of other ingredients useful in detergent compositions can be included in the compositions hereof, including other active ingredients, carriers, hydrotropes, draining promoting agents, processing aids, corrosion inhibitors, dyes or pigments, oxygen bleaches, bleach activators, etc.

If present, the above-described other optional materials generally are enzyme compatible and comprise no more than about 10% by weight of the total composition and are dissolved, suspended, or emulsified in the present compositions.

Composition

Preferred viscoelastic, thixotropic, liquid, polymer-containing detergent compositions hereof will preferably be formulated such that during use in aqueous operations, the wash water will have a pH of between about 7 and 12, preferably between about 8 and 11.

Preferred herein are gel and/or paste automatic dishwashing detergent compositions, more preferably gel automatic dishwashing detergent compositions. This invention also allows for concentrated gel automatic dishwashing detergent compositions. By "concentrated" is meant that these compositions will deliver to the wash the same amount of active detersive ingredients at a lower dosage.

Concentrated gel automatic detergent compositions herein contain about 10 to 100 weight % more active detersive ingredients than regular gel automatic dishwashing detergent compositions. Preferred are gel automatic dishwashing detergent compositions with from about 10 to 100, preferably 20 to go, most preferably 25 to 80, weight % of active deterslye ingredients.

The Method

First, a slurry comprising from about 0.01% to about 40%, preferably from about 0.1% to about 10%, most preferably from about 1% to about 6%, of polymeric, thixotropic thickener is obtained or prepared. The polymeric, thixotropic thickener is preferably a cross-linked polymer with a molecular weight between about 500,000 and 10,000,000, more preferably between about 750,00 and about 4,000,000. The liquid medium in which the slurry is made can be one of the detergent liquid ingredients of the composition in combination with a pH adjusting agent and/or a surfactant and/or another dispersant like additive to aid in slurrying the polymer. Preferably the liquid medium is selected from the group consisting of water, acidic water, surfactant and mixtures thereof. In addition, other powder form ingredients may be dry blended with the polymer powder prior to dispersion to further aid in processing.

The polymeric slurry is prepared under moderate to high shear rate until the polymeric, thixotropic thickener is substantially dissolved and/or substantially dispersed in liquid medium. Conventional methods which would induce moderate to high shear for short residence time may be used, such as ejector mixers, eductors, collid mills, homogenizers or tri-blenders. The duration of the shear rate should be minimal but sufficient to substantially dissolve and/or disperse the polymer.

The second step herein is separately mixing a detergent premix comprising other detergent ingredients, preferably detergency builders, detergent surfactants, pH adjusting agents, enzyme stabilizing system (if enzymes are in the final product), water, organic dispersants, and mixtures thereof. Most preferably the premix comprises a portion of the detergency builders and pH adjusting agents. These ingredients are mixed under low to medium shear rate using conventional methods of agitation such as paddle mixers, axial flow turbines, pitch turbines, and the like, preferably pitch turbines. The premix can additionally be recirculated through a grinding device such as a Gifford-Wood, Ross, Tekmar, or Reis high shear mixer.

The third step of the method is combining the polymeric slurry with the premix by simultaneously adding and mixing, preferably the two are added at exactly the same moment. The objective is to balance the time of dispersion of the slurry with the speed of chemical neutralization. For maximum efficiency and viscosity, the polymer needs to be fully dispersed on a molecular level before neutralization occurs to avoid the formation of "fisheyes". This is best achieved under moderate to high shear level before neutralization occurs to avoid the formation of "fisheyes". This is best achieved under moderate to high shear conditions. However, the time period in which the polymer is subjected to high shear needs to be minimized as the polymer in its neutralized form is subject to rheodestruction under prolonged high shear conditions. This invention provides a process in which the polymer is purposely subjected to high shear mixing with a minimum exposure time. The ingredients are fully blended and a desired viscosity of at least about 250 centipoise is achieved. The polymer slurry may be added in this step to a well agitated vessel of the premix if the polymer slurry is injected close to the agitation source at its maximum high shear zone. The more preferred method is to use an in-line high shear mixer, such as a static mixer or plate and frame heat exchanger. The polymer slurry and premix are injected simultaneously into the high shear mixer, thus reducing residence time (short duration) and yielding a fully dispersed and neutralized polymer. The premix may be recirculated through the high shear mixing device as the polymer slurry is slowly added, more preferred is to blend the polymer slurry and the premix at the desired ratio through the high shear mixing device into another storage vessel ("single pass"). This "single pass" is most effective at minimizing the total time the polymer is exposed to a high shear rate.

The next step, which may be the final step, is the deaerating of the blended premix and polymeric slurry. Deaeration is accomplished by either extended (continued) mixing or adding and mixing perfume or solid detergent materials which are solid and/or crystalline solid generally are not limited to the builders and suds suppressors. Preferably a portion of the builders is added in the second step with the remaining portion being added in this step.

An optional final step is the addition of ingredients which are shear pH or temperature sensitive or create or stabilize foam during mixing. These materials include but are not limited to enzymes, chlorine bleaches and surfactants.

The composition may be cooled after a final product is achieved and stored at about 100° F. (37.8° C.), preferably below about 90° F. (32.2° C.). Cooling the composition prevents degradation of chlorine bleach and/or enzyme in the composition.

The above-described process gives the best control over finished product theology and minimizes any potential to overshear and rheodestruct the polymer. The method also ensures that the solid materials are substantially dispersed and/or dissolved prior to introduction of the polymer thickener. This reduces the likelihood of solid materials being suspended and causing the finished product to be opaque. Compositions prepared as above described exhibit a viscoelastic, thixotropic nature, good rheology, and enhanced aesthetics. The following examples illustrate the compositions of the present invention. All parts, percentages and ratios used herein are by weight unless otherwise specified.

EXAMPLE I

Viscoelastic, thixotropic, liquid polymer-containing detergent compositions containing chlorine are as follows:

| | % Weight | | |
|---|---|---|---|
| Ingredients | 1 | 2 | 3 |
| Polymer Slurry | | | |
| Distilled water | 23.658 | 19.667 | 17.140 |
| Nitric acid (71%) | 0.092 | 0.092 | 0.042 |
| Polymer thickener[1] | 1.250 | 1.150 | 1.000 |
| | 25.000 | 20.909 | 18.182 |
| Premix | | | |
| Distilled water | 10.539 | 21.759 | 3.388 |
| Potassium hydroxide (45%) | 5.778 | 4,364 | 8.000 |
| 2.1r potassium silicate (39.15%) | 13.512 | 7.763 | 35.000 |
| 3.2r Sodium silicate (38.6%) | 0.000 | 5.181 | 0.000 |
| Tetra potassium pyrophosphate (60%) | 14.000 | 0.000 | 0.000 |
| Potassium carbonate | 8.300 | 8.300 | 0.000 |
| Sodium tripolyphosphate | 9.350 | 17.500 | 15.000 |
| Potassium tripolyphosphate | 0.000 | 0.000 | 7.000 |
| Lithium hydroxy stearate | 0.100 | 0.000 | 0.000 |
| Aluminum tristearate | 0.000 | 0.100 | 0.100 |
| | 61.579 | 64.967 | 68.488 |
| Polymer slurry and premix blend | | | |
| Polymer slurry | 25.000 | 20.909 | 18.182 |
| Premix | 61.579 | 64.967 | 68.488 |
| | 86.579 | 85.876 | 86.670 |
| Finished Product | | | |
| Polymer/premix blend | 86.579 | 85.876 | 86.670 |
| Yellow dye #6 (1%) | 0.200 | 0.200 | 0.200 |
| 2.1r potassium silicate (39.15%) | 2.427 | 2.427 | 2.500 |
| Lemon perfume | 0.050 | 0.050 | 0.050 |
| Sodium polyacrylate (45%)[2] | 1.111 | 0.000 | 0.500 |
| Anionic surfactant (45%)[3] | 0.000 | 0.800 | 0.500 |
| Sodium benzoate (33.3%) | 2.250 | 2.250 | 2.250 |
| Sodium hypochlorite | 7.383 | 8.397 | 0.000 |
| Potassium hypochlorite | 0.000 | 0.000 | 7.330 |
| TOTAL: | 100.000 | 100.000 | 100.000 |

[1]Polygel DK, 3-V Chemical
[2]molecular weight about 4500
[3]DOWFAX ® 3B2, Dow Chemical The polymer slurry is prepared using an ejector mixer and the premix is prepared by simple agitation, stirring. The polymer slurry and premix blend is obtained using a static mixer. The finished product ingredients are added and mixed sequentially. After the addition of perfume the composition specific gravity is measured, addition of the remaining ingredients continues once the desired specific gravity is achieved.

All of the compositions exhibit good aesthetics and phase stability.

EXAMPLE II

Viscoelastic, thixotropic, liquid polymer-containing automatic dishwashing detergents containing enzymes are as follows:

| | % Weight | | |
|---|---|---|---|
| Ingredients | 4 | 5 | 6 |
| Polymer Slurry | | | |
| Distilled water | 42.913 | 42.913 | 17.958 |
| Nitric acid (71%) | 0.042 | 0.042 | 0.042 |
| Polymer thickener[1] | 2.500 | 2.500 | 2.000 |
| | 45.455 | 45.455 | 20.000 |
| Premix | | | |
| Distilled water | 13.935 | 3.935 | 6.680 |
| Sodium hydroxide (45%) | 12.800 | 12.800 | 20.000 |
| Sodium Polyacrylate (45%)[2] | 2.500 | 2.500 | 5.000 |
| Boric acid | 2.000 | 2.000 | 4.000 |
| 1,2 propanediol | 4.700 | 4.700 | 9.400 |
| Sodium carbonate | 0.000 | 8.000 | 8.000 |
| Sodium citrate | 0.000 | 0.000 | 14.000 |
| Citric acid (50%) | 14.000 | 14.000 | 0.000 |
| Sodium cumene sulfonate (45%) | 1.000 | 1.000 | 2.000 |
| Monoethanolamine | 1.800 | 1.800 | 3.600 |
| Aluminum tristearate | 0.000 | 0.000 | 0.100 |
| | 52.735 | 50.735 | 72.780 |
| Polymer slurry and premix blend | | | |
| Polymer slurry | 45.455 | 45.455 | 20.000 |
| Premix | 52.735 | 50.735 | 72.780 |
| | 98.190 | 96.190 | 92.780 |
| Finished Product | | | |
| Polymer/premix blend | 98.190 | 96.190 | 92.780 |
| Yellow dye #6 (1%) | 0.200 | 0.200 | 0.400 |
| Lemon perfume | 0.050 | 0.050 | 0.100 |
| Sodium carbonate | 0.000 | 2.000 | 2.000 |
| Nonionic surfactant[3] | 1.500 | 1.500 | 3.000 |
| Anionic surfactant[4] | 0.000 | 0.000 | 1.000 |
| Suds suppression agent | 0.000 | 0.000 | 0.000 |
| Protease enzyme[5] | 0.030 | 0.030 | 0.060 |
| Amylase enzyme[6] | 0.030 | 0.030 | 0.060 |
| Lipase enzyme[7] | 0.000 | 0.000 | 0.600 |
| TOTAL: | 100.000 | 100.000 | 100.000 |

[1]Polygel DK, 3-V Chemical
[2]molecular weight about 4500
[3]PLURONIC ® 25R2, BASF
[4]DOWFAX ® 3B2, Dow Chemical
[5]Esperase ® 8.0L, Novo Nordisk
[6]MAXAMYL WL 15000, IBIS
[7]Lipolase ® 1001, Novo Nordisk The above components are mixed as in Example I with the exception that the specific gravity is measured after the addition and mixing of the sodium carbonate. After the desired specific gravity is achieved the remaining ingredients are sequentially added.

All of the compositions exhibit good aesthetics and phase stability.

EXAMPLE III

Viscoelastic, thixotropic liquid automatic dishwashing detergent compositions are as follows:

TABLE 1

| Ingredients | % Weight | | | |
|---|---|---|---|---|
| | 7 | 8 | 9 | 10 |
| Sodium citrate | 6.85 | 6.85 | 6.85 | 6.85 |
| Sodium hydroxide (50%) | 1.90 | 1.90 | 1.90 | 1.90 |
| Sodium carbonate | 0.00 | 0.00 | 0.00 | 8.00 |
| Aluminum tristearate | 0.10 | 0.10 | 0.10 | 0.00 |
| Polyacrylate thickener(1) | 1.32 | 1.32 | 2.00 | 2.50 |
| Dye | 0.0016 | 0.0016 | 0.0016 | 0.0016 |
| Perfume | 0.05 | 0.05 | 0.05 | 0.05 |
| Sodium cumene sulfonate | 0.00 | 0.00 | 0.00 | 0.85 |
| Sodium polyacrylate(2) | 2.40 | 2.40 | 2.40 | 2.40 |
| Block copolymer surfactant(3) | 1.50 | 1.50 | 1.50 | 1.50 |
| Boric acid | 2.00 | 0.00 | 0.00 | 2.00 |
| 1,2-propanediol | 0.00 | 0.00 | 0.00 | 4.70 |
| Calcium formate | 0.00 | 0.20 | 0.20 | 0.00 |
| Sodium formate | 0.00 | 0.45 | 0.45 | 0.00 |
| Protease enzyme(4) | 0.0235 | 0.0235 | 0.0235 | 0.0235 |
| Amylase enzyme(5) | 0.0078 | 0.0078 | 0.0078 | 0.0078 |
| Water and trim | Balance | | | |

(1)Polygel DK, 3-V Chemical Corporation
(2)Molecular weight about 4500
(3)PLURONIC ® 25R2
(4)Esperase ® 8.0L, Novo Nordisk
(5)MAXAMYL WL 15000

The compositions are prepared as set forth in Example II. Compositions 1–4 demonstrate the use of various enzyme stabilizing systems, i.e. boric acid (composition 1 ), boric acid and 1,2-propanediol (composition 4), and calcium/sodium formate (compositions 2 and 3). All exhibit enhanced cleaning, spotting and filming performance and phase stability when stored up to about ten (10) weeks at from about 40° F. ( 4.4° C.) to about 120 ° F. (48.9° C.).

EXAMPLE IV

Viscoelastic, thixotropic liquid automatic dishwashing detergent compositions are shown below containing chlorine scavengers.

TABLE 4

| Ingredients | % Weight | | | |
|---|---|---|---|---|
| | 11 | 12 | 13 | 14 |
| Sodium citrate | 6.85 | 6.85 | 0.00 | 0.00 |
| Sodium tripolyphosphate | 0.00 | 0.00 | 7.50 | 7.50 |
| Sodium hydroxide (50%) | 1.90 | 1.90 | 1.90 | 1.90 |
| Sodium carbonate | 0.00 | 0.00 | 5.50 | 5.50 |
| Aluminum tristearate | 0.10 | 0.10 | 0.00 | 0.00 |
| Polacrylate thickener(1) | 1.32 | 1.32 | 2.50 | 2.50 |
| Dye | 0.0016 | 0.0016 | 0.0016 | 0.0016 |
| Perfume | 0.05 | 0.05 | 0.05 | 0.05 |
| Sodium cumene sulfonate | 0.00 | 0.00 | 0.85 | 0.85 |
| Sodium polyacrylate(2) | 2.40 | 2.40 | 2.40 | 2.40 |
| Block copolymer surfactant(3) | 1.50 | 1.50 | 1.50 | 1.50 |
| Sodium n-decydiphenyloxide disulfonate(4) | 0.00 | 0.00 | 1.00 | 0.00 |
| Boric acid | 2.00 | 2.00 | 2.00 | 2.00 |
| 1,2-propanediol | 0.00 | 4.70 | 4.70 | 4.70 |
| Protease enzyme(5) | 0.0236 | 0.0236 | 0.2000 | 0.2000 |
| Amylase enzyme(6) | 0.0078 | 0.0078 | 0.2000 | 0.2000 |
| Lipase enzyme(7) | 0.00 | 0.00 | 0.00 | 0.00 |
| C12–14 fatty acid | 0.00 | 0.00 | 0.50 | 0.00 |
| Monoethanolamine (MEA) | 0.93 | 0.93 | 0.93 | 0.93 |
| Suds suppressor(8) | 0.00 | 0.00 | 0.75 | 0.00 |

TABLE 4-continued

| Water and trim | Balance | | | |
|---|---|---|---|---|
| Ingredients | 15 | 16 | 17 | 18 |
| Sodium citrate | 3.00 | 6.85 | 6.85 | 6.85 |
| Sodium tripolyphosphate | 0.00 | 0.00 | 0.00 | 0.00 |
| Sodium hydroxide (50%) | 1.90 | 1.90 | 1.90 | 1.90 |
| Sodium carbonate | 0.00 | 0.00 | 0.00 | 0.00 |
| Aluminum tristearate | 0.00 | 0.00 | 0.00 | 0.00 |
| Polyacrylate thickener(1) | 2.50 | 2.50 | 2.50 | 2.50 |
| Dye | 0.0016 | 0.00 | 0.00 | 0.00 |
| Perfume | 0.05 | 0.05 | 0.05 | 0.05 |
| Sodium cumene sulfonate | 0.85 | 0.85 | 0.85 | 0.85 |
| Sodium Polyacrylate(2) | 2.40 | 3.00 | 3.0 | 3.00 |
| Block co-polymer surfactant(3) | 7.00 | 1.50 | 1.50 | 1.50 |
| Sodium n-decydiphenyloxide disulfonate(4) | 0.00 | 0.00 | 0.00 | 0.00 |
| Boric acid | 2.00 | 2.00 | 2.00 | 2.00 |
| 1,2-propanediol | 4.70 | 4.70 | 4.70 | 4.70 |
| Protease enzyme(5) | 0.0235 | 0.10 | 0.10 | 0.50 |
| Amylase enzyme(6) | 0.0078 | 0.00 | 0.10 | 0.00 |
| Lipase enzyme(7) | 0.00 | 0.30 | 0.30 | 0.00 |
| C12–14 fatty acid | 0.00 | 0.50 | 0.50 | 0.50 |
| Monoethanolamine (MEA) | 0.93 | 0.93 | 0.93 | 0.93 |
| Suds suppressor(8) | 0.00 | 0.00 | 0.00 | 0.00 |
| Water and trim | Balance | | | |

(1)Polygel DK, 3-V Chemical Corporation
(2)Molecular weight about 4500
(3)PLURONIC ® 25R2
(4)DOWFAX ® 3B2 (45%), BASF Corporation
(5)Esperase ® 8.0L, Novo Nordisk
(6)MAXAMYL WL 15000
(7)Lipolase ® 100L Novo-Nordisk
(8)MSAP, Hooker Chemical or LPKN, Knapsack The compositions are prepared as set forth in Example II. Compositions 5–12 demonstrate the use of chlorine scavengers in viscoelastic, thixotropic liquid automatic dishwashing detergent compositions. All exhibit enhanced cleaning, spotting and filming performance and phase stability when stored up to about ten (10) weeks at from about 40° F. (4.4° C.) to about 120° F. (48.9° C.).

EXAMPLE V

A concentrated, viscoelastic, thixotropic liquid automatic dishwashing detergent composition prepared as in Example II is as follows:

TABLE 5

| Ingredients | % Weight |
|---|---|
| Citric acid | 11.91 |
| Sodium hydroxide | 9.29 |
| Polyacrylate thickener(1) | 2.50 |
| Dye | 0.0032 |
| Perfume | 0.20 |
| Sodium cumene sulfonate | 1.70 |
| Sodium polyacrylate(2) | 6.00 |
| Block copolymer surfactant(3) | 3.00 |
| Boric acid | 4.00 |
| 1,2-propanediol | 9.40 |
| Protease enzyme(5) | 0.0472 |
| Amylase enzyme(6) | 0.0156 |
| Water and trim | Balance |

(1)Polygel DK, 3-V Chemical Corporation
(2)Molecular weight about 4500
(3)PLURONIC ® 25R2, BASF Corporation
(5)Esperase ® 8.0L, Novo Nordisk
(6)MAXAMYL WL 15000, IBIS (International Biosynthetics Inc.)

EXAMPLE VI

Concentrated gel automatic dishwashing detergent compositions with chlorine scavengers prepared as in Example II are shown below.

TABLE 6

| Ingredients | % Weight | | | |
|---|---|---|---|---|
| | 20 | 21 | 22 | 23 |
| Citric acid | 11.91 | 12.00 | 0.00 | 0.00 |
| Sodium tripolyphosphate | 0.00 | 0.00 | 15.00 | 15.00 |
| Sodium hydroxide (50%) | 9.29 | 9.30 | 1.90 | 1.90 |
| Polyacrylate thickener(1) | 2.50 | 2.50 | 2.50 | 2.50 |
| Dye | 0.0016 | 0.00 | 0.00 | 0.00 |
| Perfume | 0.20 | 0.05 | 0.05 | 0.05 |
| Sodium cumene sulfonate | 1.70 | 1.70 | 1.70 | 1.70 |
| Sodium polyacrylate(2) | 6.00 | 6.00 | 6.00 | 6.00 |
| Block copolymer surfactant(3) | 3.00 | 3.00 | 3.00 | 15.00 |
| Sodium n-decydiphenyloxide disulfonate(4) | 0.00 | 2.00 | 2.00 | 0.00 |
| Boric acid | 4.00 | 2.00 | 2.00 | 2.00 |
| 1,2-propanediol | 9.40 | 4.70 | 4.70 | 4.70 |
| Protease enzyme(5) | 0.0472 | 0.05 | 0.05 | 0.05 |
| Amylase enzyme(6) | 0.0156 | 0.02 | 0.02 | 0.02 |
| C12–14 fatty acid | 0.00 | 0.50 | 0.50 | 0.50 |
| Monoethanolamine (MEA) | 1.86 | 0.93 | 0.93 | 0.93 |
| Suds suppressor(8) | 0.00 | 0.50 | 0.50 | 0.50 |
| Water and trim | Balance | | | |

(1)Polygel DK, 3-V Chemical Corporation
(2)Molecular weight about 4500
(3)PLURONIC ® 25R2
(4)DOWFAX ® 3B2 (45%), BASF Corporation
(5)Esperase ® 8.0L, Novo Nordisk
(6)MAXAMYL WL 15000
(8)MSAP, Hooker Chemical or LPKN, Knapsack

EXAMPLE VII

Viscoelastic, thixotropic liquid automatic dishwashing detergent compositions prepared as set forth in Example II are as follows:

TABLE 7

| Ingredients | % Weight | | | |
|---|---|---|---|---|
| | 24 | 25 | 26 | 27 |
| Sodium citrate | 0.00 | 0.00 | 9.00 | 9.00 |
| Sodium hydroxide (50%) | 1.90 | 1.90 | 1.90 | 1.90 |
| Sodium carbonate | 0.00 | 0.00 | 0.00 | 8.00 |
| Aluminum tristearate | 0.10 | 0.10 | 0.10 | 0.00 |
| Polyacrylate thickener(1) | 1.50 | 1.50 | 2.00 | 2.50 |
| Dye | 0.0002 | 0.0002 | 0.0002 | 0.0002 |
| Perfume | 0.05 | 0.05 | 0.05 | 0.05 |
| Sodium cumene sulfonate | 0.00 | 0.00 | 0.00 | 0.85 |
| Sodium Polyacrylate(2) | 2.40 | 2.40 | 2.40 | 2.40 |
| Sodium n-decydiphenyloxide | | | | |

What is claimed is:

1. A process for preparing a viscoelastic, thixotropic, liquid, polymer-containing detergent composition consisting essentially of:

(a) forming a slurry of from about 0.01% to about 40%, by weight of said slurry, of a polymeric, thixotropic thickener selected from the group consisting of cross-linked polycarboxylate polymers with a molecular weight between 750,000 and about 4,000,000, natural gums, cellulosic material and mixtures thereof in a liquid medium;

(b) separately mixing to form a premix composition comprising detergency builder, pH adjusting agent, fatty acid, rheology stabilizing agent, organic dispersant, detergent surfactant, suds suppressor, enzyme stabilizing system, oxidizing agents, water, and mixtures thereof;

(c) simultaneously adding and mixing under moderate to high shear said slurry of step (a) with said premix of step (b) for a sufficient period of time to neutralize and disperse said polymer to form a composition with a viscosity of at least about 250 centipoise; and (d) deaerating by mixing and sequentially adding from about 0.01% to about 40%, by weight, of organic solvents, oils, suds suppressors, solid detergent material and mixtures thereof, at low to moderate shear rate, to said composition of step (c) to form a final product with a specific gravity of about 1.0 to about 2.0.

2. The process of claim 1 wherein said premix of step (b) comprises detergency builder and pH adjusting agent and mixtures thereof.

3. The process of claim 2 further comprising step (e) of adding and mixing under low to moderate shear detergent ingredients which are high foaming, pH sensitive, temperature sensitive, or high shear sensitive to the composition of step (d).

4. The process of claim 3 wherein said liquid medium is selected from the group consisting of water, water with a pH less than about 7.0, detergent surfactant, pH adjusting agent and mixtures thereof.

5. The process of claim 4 wherein said solid material of step (d) is detergency builder.

6. The process of claim 5 wherein said detergent builder of step (b) or step (d) is selected from the group consisting of citric acid, alkali metal citrate, alkali metal tripolyphosphate, alkali metal silicates, alkali metal pyrophosphate, oxydisuccinate, polyphosphonates, tartrate monodisuccinate, tartrate disuccinate, alkali metal carbonates, polycarboxylates, and mixtures thereof.

7. The process of claim 6 comprising deaerating said composition of step (d) while adding perfume, solvents and oils and adding said chlorine bleach and rheology stabilizing agent in step (e).

8. The process of claim 7 wherein said composition comprises:

(a) from about 0.1% to about 10% of said cross-linked polycarboxylate polymer thickening agent;

(b) from about 0.1% to about 40% of said detergency builder;

(c) a chlorine bleach ingredient providing from about 0.01% to about 5% available chlorine; and (e) from about 0.1% to about 5% of said rheology stabilizing agent selected from the group consisting of benzoic acid, phthalic acid, toluic acid, or a salt, or a mixture thereof.

9. The process of claim 6 wherein said polymer slurry of step (a) is formed by ejector mixer, eductor, colloid mill, homogenizer or tri-blender.

10. The process of claim 9 comprising deaerating said composition of step (d) while adding builder and adding said enzyme in step (e).

11. The process of claim 10 wherein said viscoelastic, thixotropic, liquid, polymer-containing detergent composition is an automatic dishwashing detergent consisting essentially of, by weight:

(a) from about 0.001% to about 5% of said active detersive enzyme or enzymes;

(b) from about 0.1% to about 10% of said viscoelastic, thixotropic thickener;

(c) from about 0.001% to about 10% of said enzyme stabilizing system selected from the group consisting of calcium ion, propylene glycol, short chain carboxylic acid, polyhydroxyl compounds, boric acid, boronic acid and mixtures thereof;

(d) from about 0.01% to about 40% of said detergent surfactant or a detergent builder or mixtures thereof; and (e) sufficient pH adjusting agent to provide said composition with a product pH between about 7 and about 11;

wherein said composition is substantially free of chlorine bleach and silicates.

12. The process of claim 11 wherein said enzyme is selected from the group consisting of protease, lipase, amylase and mixtures thereof.

13. The process of claim 11 wherein said enzyme stabilizing system further comprises from about 0.01% to about 6% of a chlorine scavenger which is a salt containing ammonium cation.

14. The process of claim 13 comprising from about 0.003% to about 4% of said active detersive enzyme.

15. The process of claim 14 wherein said product pH is between about 8 and about 11.5.

16. The process of claim 9 wherein said composition of step (c) is formed by static mixer or plate and frame heat exchanger.

17. The process of claim 16 comprising from about 0.01% to about 99.9% by weight of the composition of step (b) premix.

18. The process of claim 17 wherein said premix of step (b) is mixed by paddle mixer, axial flow turbine, and pitch turbine.

19. The process of claim 5 wherein said detergent ingredients of step (e) are selected from the group consisting of detergent surfactant, chlorine bleach, enzyme, rheology stabilizing agent and mixtures thereof.

* * * * *